United States Patent [19]

Manchak, Jr.

[11] Patent Number: 4,897,221

[45] Date of Patent: Jan. 30, 1990

[54] PROCESS AND APPARATUS FOR CLASSIFYING, SEGREGATING AND ISOLATING RADIOACTIVE WASTES

[76] Inventor: Frank Manchak, Jr., 11300 S. Norwalk Blvd., Santa Fe Springs, Calif. 90670

[21] Appl. No.: 160,814

[22] Filed: Feb. 26, 1988

[51] Int. Cl.[4] ..... G21F 9/12; G21F 9/24; B28B 1/02; B28B 1/20

[52] U.S. Cl. ..... 252/633; 252/478; 252/628; 252/632; 250/506.1; 405/128; 405/129; 494/66; 494/85; 264/260; 264/270; 264/310; 264/311

[58] Field of Search ..... 252/630, 633, 628, 632; 110/342, 237, 238; 250/506.1, 507.1; 264/260, 270, 310, 311; 494/36, 37, 66, 67, 76, 85; 405/128, 129; 209/199

[56] References Cited

U.S. PATENT DOCUMENTS

| | | | |
|---|---|---|---|
| 4,053,432 | 10/1977 | Tiepel et al. | 252/632 |
| 4,230,660 | 10/1980 | Taylor et al. | 264/311 |
| 4,274,962 | 6/1981 | Queiser et al. | 252/632 |
| 4,477,373 | 10/1984 | Grantham et al. | 252/632 |
| 4,555,361 | 11/1985 | Buckley et al. | 252/632 |
| 4,572,959 | 2/1986 | Popp et al. | 250/506.1 |
| 4,579,069 | 4/1986 | Gay et al. | 110/342 |
| 4,581,163 | 4/1986 | Meininger et al. | 252/633 |
| 4,642,186 | 2/1987 | Nakamura | 210/257.1 |
| 4,659,511 | 4/1987 | Fukasawa et al. | 252/628 |
| 4,681,705 | 7/1987 | Robertson | 252/631 |

*Primary Examiner*—Howard J. Locker
*Attorney, Agent, or Firm*—Roth & Goldman

[57] ABSTRACT

Low-level radioactive wastes and the like are identified by composition and segregated based on specific contaminants identified. The separated wastes are subsequently encapsulated in a centrifugal process prior to disposal. The wastes advantageously are subjected to heat prior to classification in order to remove any volatiles and hydrocarbons present.

9 Claims, 9 Drawing Sheets

DRYER
TO 312
236
OFF-GAS TO CLEAN-UP SYSTEM
239
12
10
234
226
69
18
22
58
54
14
64
20
16
24
W
SOLVENT LIQUOR
232
SOLVENT RECOVERY SYSTEM
228
30
42
32
70
28
SHREDDER
48
FID
50
GC
44
AIR
SOLID WASTE
34
230
RETURN CONTAMINATED WASTE FOR REPROCESSING FROM 324
26
UNMIXED WASTES TO 312
CHART RECORDER
52
46
RECORDER ANALYZERS
-40-
PH
36
RESIDUE RETURN TO CASTING OR TREATMENT
WASTE IN
31
25
29
27
UNCONTAMINATED WASTE OUT

FIG. 2
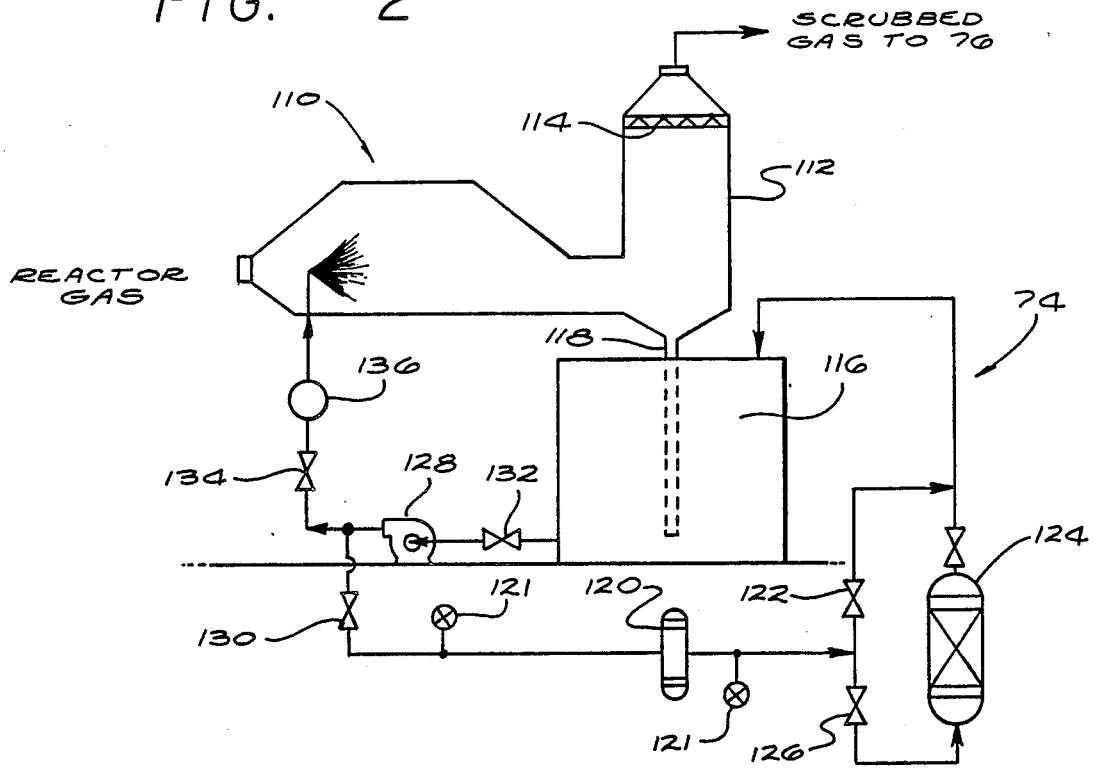
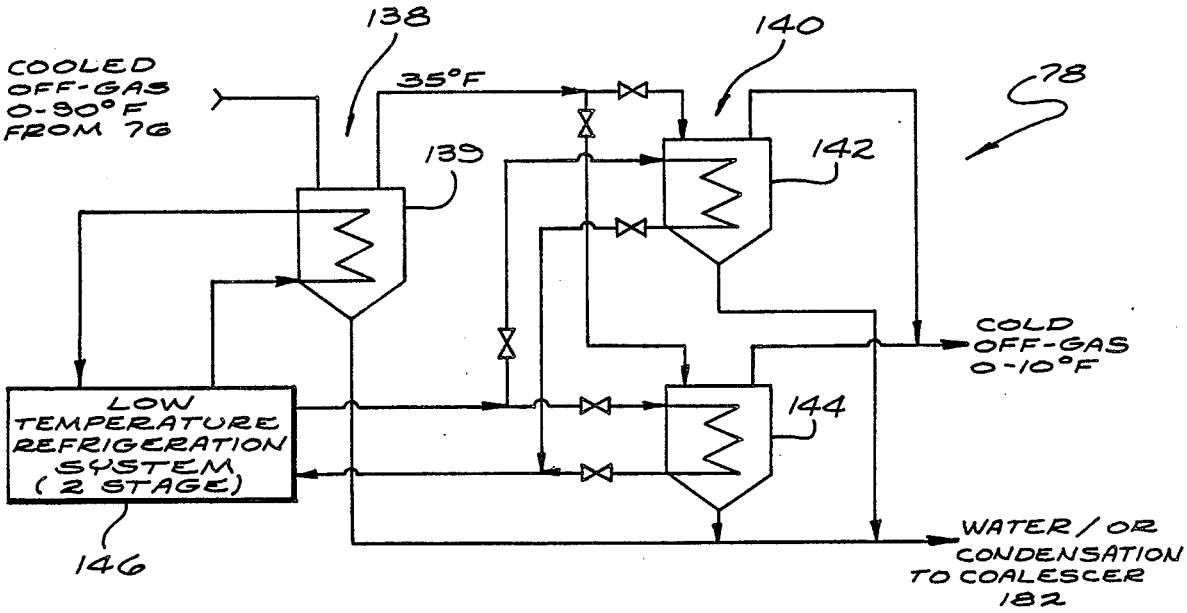
FIG. 3

FIG. 8
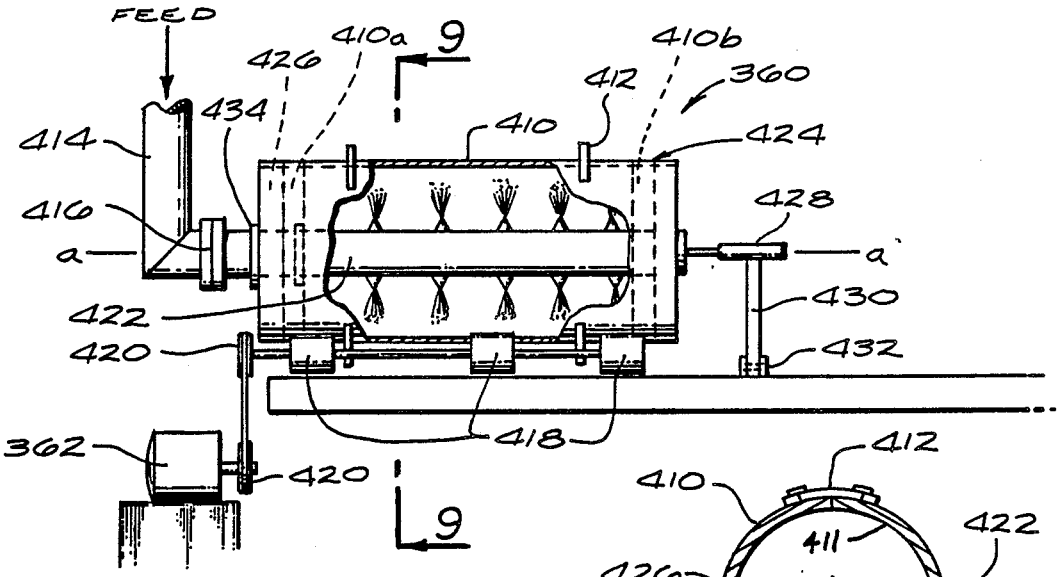
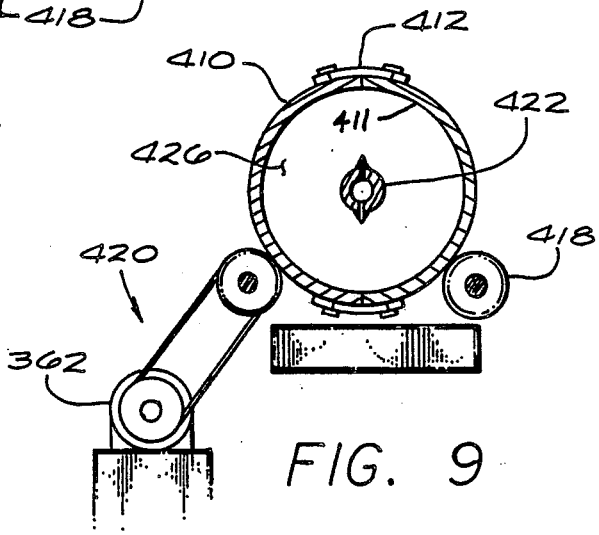
FIG. 9
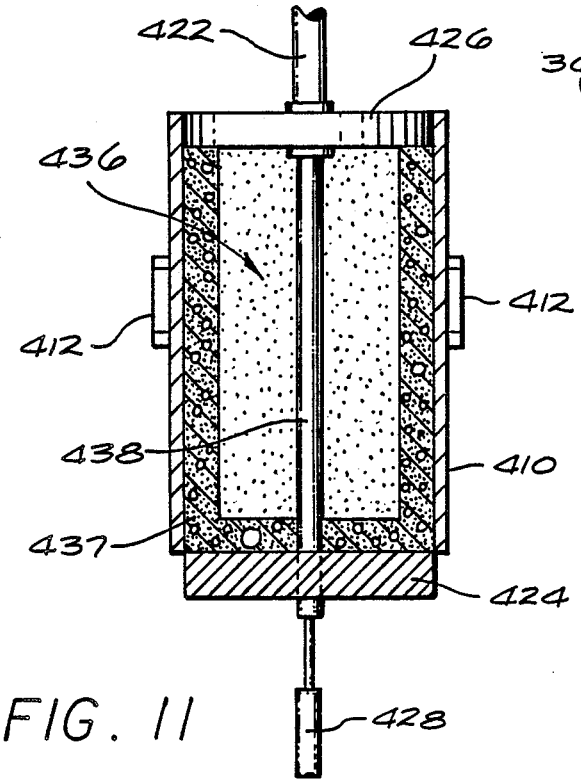
FIG. 11
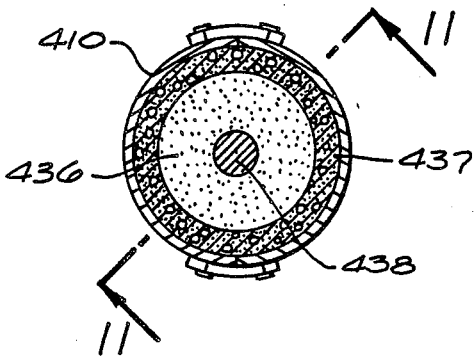
FIG. 10

PROCESS AND APPARATUS FOR CLASSIFYING, SEGREGATING AND ISOLATING RADIOACTIVE WASTES

FIELD OF THE INVENTION

This invention relates generally to processing of radioactive waste pursuant to disposal, and more particularly to the classification, separation, and isolation of the low-level radioactive waste (LLW) prior to disposal of the waste in a repository facility.

Radioactive waste is legally defined in Chapter 23 of title 42 of the United States Code as belonging to one of four categories: High Level and Spent Nuclear Fuel, Transuranic, Mill Tailings, and Low Level. These four waste categories are defined as follows:

1. High level waste is defined as the highly radioactive material resulting from the reprocessing of spent nuclear fuel, which includes liquid waste production and any solid material derived from such operations that contains fission products in sufficient concentrations requiring permanent isolation. Spent nuclear fuel on the other hand is defined as "fuel that has been withdrawn from a nuclear reactor following irradiation, the constituent elements of which have not been separated by reprocessing." These wastes are exclusively generated by commercial power reactors, research reactors, or reactors used for defense activities of the Federal Government.

2. Transuranic (TRU) Waste is defined as waste material containing radionuclides with an atomic number greater than element 92, and emitting penetrating radiation with a concentration greater than 10 nanocuries per gram of waste. If the concentration was lower, it was considered low level waste. TRU waste is primarily generated by defense activities. Since most of the TRU radionuclides have a very long toxic half-life, the most suitable method for disposal is isolation in geological repositories. TRU waste is typically produced in relatively small volumes which may contain very high concentrations of fission products and transuranics, and thus requires massive shielding during handling.

3. Mill tailings are defined as "the remaining portion of the metal bearing ore after some or all of the material, such as uranium, has been extracted, or other waste produced by the extraction or concentration of uranium or thorium from any ore processed primarily for this source material content. Special consideration for disposal must be given to radon, since it is a noble gas and, therefore, very difficult to contain due to the large volumes that are generated, disposal of mill tailings usually occurs very near the source of generation.

4. Low level wastes (LLW) are defined as "radioactive waste not classified as high level radioactive waste, transuranic waste, spent nuclear fuel or mill tailings".

Low level radioactive wastes generally consist of various materials which have become contaminated by radionuclides in the various processes which use radioactive material. The radioactive material users that generate LLW can be divided into three broad categories: power reactor, industrial and institutional.

Since LLW is broadly defined, there may be certain waste streams which are defined as LLW but contain high concentrations of various radionuclides which may not be suitable for disposal using near surface burial techniques.

The effective control and disposal of large quantities of low-level radioactive waste is of vital importance.

DESCRIPTION OF THE PRIOR ART

A wide range of radioactive waste processes are known for the isolation of a variety of low and high-level radioactive wastes by the use of chemical and physical volume reduction, chemical fixation and solidification. The resulting product of these processes, which may be uncontaminated, slightly contaminated, or remain highly contaminated, is then packaged in drums or boxes and either transported and disposed of at remote sites or buried in trenches in the drums or boxes at the processing site. Alternatively, such drums or boxes can be placed in costly overpack containers which are then either buried or stored.

Furthermore, with known techniques all of the wastes are packaged without classification or separation as to their contaminant levels prior to packaging and burial, thereby resulting in costly packaging and disposition if the waste is only slightly or not contaminated and considered as a higher level of contamination because of its origin.

Further, the techniques presently in use do not consider the problems of isolation and disposal of mixed wastes (Mixed LLW) which are contaminated with both radioactive and chemical materials each in varying concentrations. If the organics, solvents, and other volatiles in varying concentrations are not removed or isolated prior to treatment of the radioactive waste, there may result corrosion or deterioration of the drums or containers thus releasing both chemical and radioactive contaminants into the environment.

If contaminants are to be kept isolated from the environment until total decay occurs, then some of the following steps must be performed prior to the burial or repository disposal of the waste:

The solid waste must be reduced to minimum particle size then the contaminants present in the pulverized waste must be identified and separated so to be isolated on a specific-contaminant basis. However if the product is a mixed waste, then the chemical contaminant must be removed or separated prior to the process of isolation, and the final isolation must be conducted in a process to meet all of the long range mandated requirements of isolation.

The disposal of low-level radioactive waste (LLW) is regulated by the "Low-Level Radioactive Waste Policy Act" codified at 42 United States Code, sections 2021b through 2021j.

Due to the hazardous nature of LLW, the Act permits regional LLW disposal facilities to refuse to accept waste that does not meet the definition of LLW, and to allocate, or assign, a specific amount of disposal capacity to each waste generator in the region. These requirements have created a need to precisely identify LLW and to reduce as much possible the amount of LLW for disposal.

Mixed LLW presents additional regulatory problems. Under the Resource Conservation and Recovery Act (RCRA), the U.S. Environmental Protection Agency (EPA) has jurisdiction over the disposal of solid wastes with the exception of source, byproduct, and special nuclear material, which are regulated by the U.S. Nuclear Regulatory Commission (NRC) under the Atomic Energy Act (AEA). Low-level Radioactive Wastes (LLW) contain source, byproduct, or special nuclear materials, but they may also contain chemical constituents which are hazardous under EPA regulations set forth in 40 Code of Federal Regulations Part 261. Such wastes are commonly referred to as Mixed Low-Level Radioactive and Hazardous Waste (Mixed LLW).

NRC regulations exist to control the byproduct, source, and special nuclear material components of the Mixed LLW. EPA has the authority to control the hazardous component of the Mixed LLW. Thus, all of the individual constituents of Mixed LLW are subject to either NRC or EPA regulations. But, when the components are combined to become LLW, neither agency has exclusive jurisdiction under current Federal law. This had led to a situation of dual regulation where both agencies, NRC and EPA, regulate the same waste.

A document, "Guidance on the Definition and Identification of Commercial Mixed Low-Level Radioactive and Hazardous Waste," was developed jointly by the NRC and EPA to aid commercial LLW generators in assessing whether they are currently generating Mixed LLW.

Known techniques for radioactive waste (radwaste) volume reduction prior to disposal use either stationary or mobile equipment. Solid radwastes are encapsulated in asphalt and the like before packaging, with liquid radwaste being packaged separately. Encapsulation is carried out as by an extrusion operation or by use of a thin film evaporator. Alternatively, a fluidized bed dryer and incinerator is used. The liquid wastes are concentrated and dried in the latter approach.

SUMMARY OF THE INVENTION

It is an object of present invention to provide a process of classifying, segregating and isolating radioactive wastes, and particularly mixed, low-level radioactive wastes, and to provide an apparatus for performing the method.

This and other objects are achieved according to the present invention by removing any volatiles and hydrocarbons from mixed low-level radioactive wastes and the like to be treated, identifying the composition of that portion of the wastes from which any volatiles and hydrocarbons have been removed by detecting predetermined specific contaminants in the wastes, and separating the identified wastes as a function of specific contaminants detected. The separated wastes then can be isolated as appropriate.

The volatiles and hydrocarbons advantageously are stripped by being subjected to heat in a reactor vessel.

According to a particularly advantageous feature of the invention, the separated wastes are isolated in a centrifuge either by filling with the wastes a previously formed barrier constructed from a shielding material, or by mixing the waste with a shielding material.

BRIEF DESCRIPTION OF THE DRAWINGS

FIG. 2 is a diagram of a gas scrubber system usable with the waste processing system of FIGS. 1*a* and 1*b*.

FIG. 3 is a diagram of a contaminant condensing system usable with the waste processing system of FIGS. 1*a* and 1*b*.

FIG. 8 is a diagrammatic, side-elevational view, showing a centrifuge apparatus according to the present invention.

FIG. 9 is a diagrammatic, cross-sectional view taken generally along the line 9—9 of FIG. 8.

FIG. 10 is a diagrammatic, cross-sectional view, similar to FIG. 9, but with some parts removed and showing a waste casting according to the present invention.

FIG. 11 is a diagrammatic longitudinal sectional view taken generally along the line 11—11 of FIG. 10.

DESCRIPTION OF THE PREFERRED EMBODIMENT

Figure 1A:
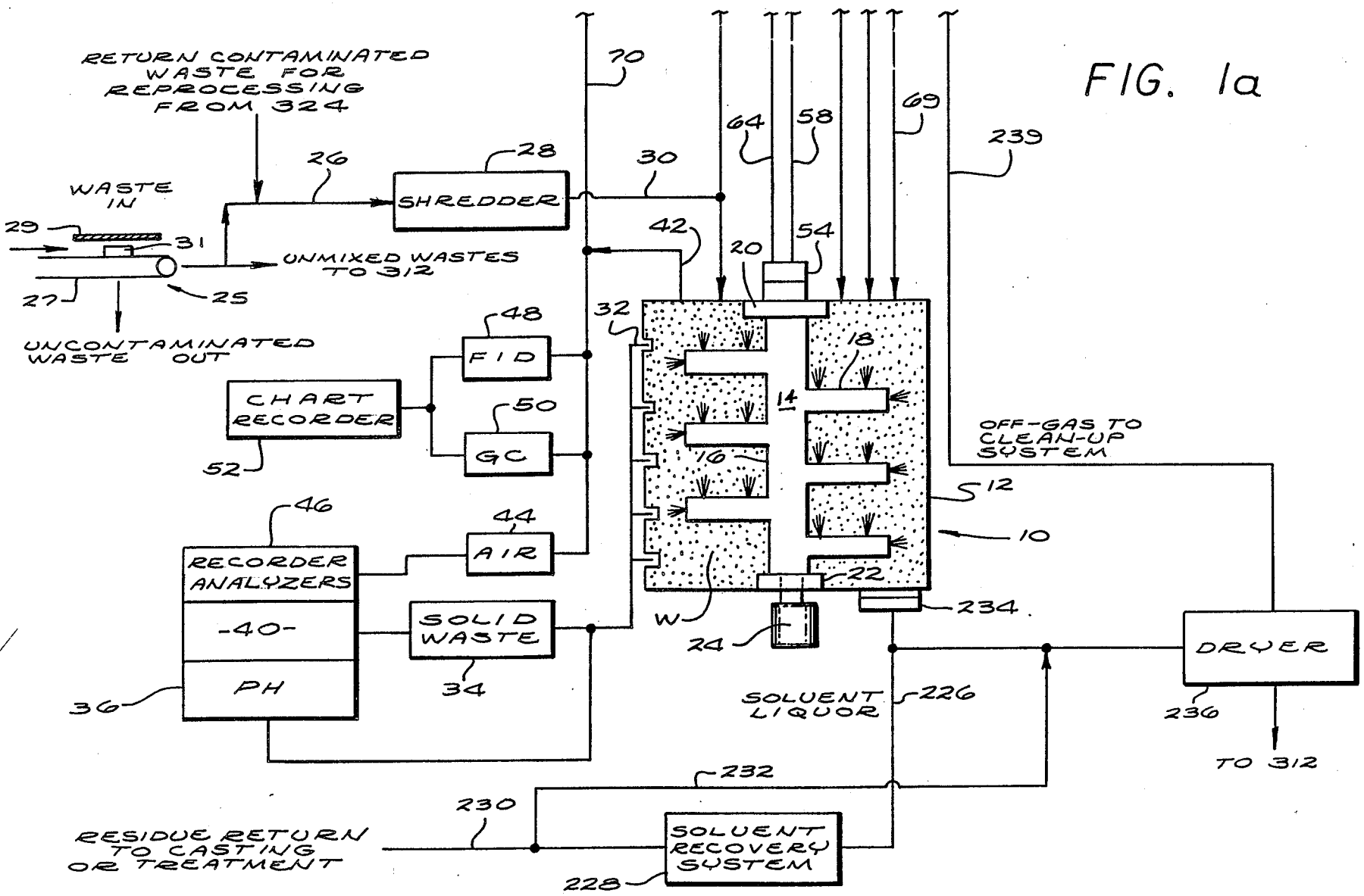
FIGS. 1*a*, 1*b* and 1*c* are diagrams of a waste processing system according to the present invention.
Figure 1B:
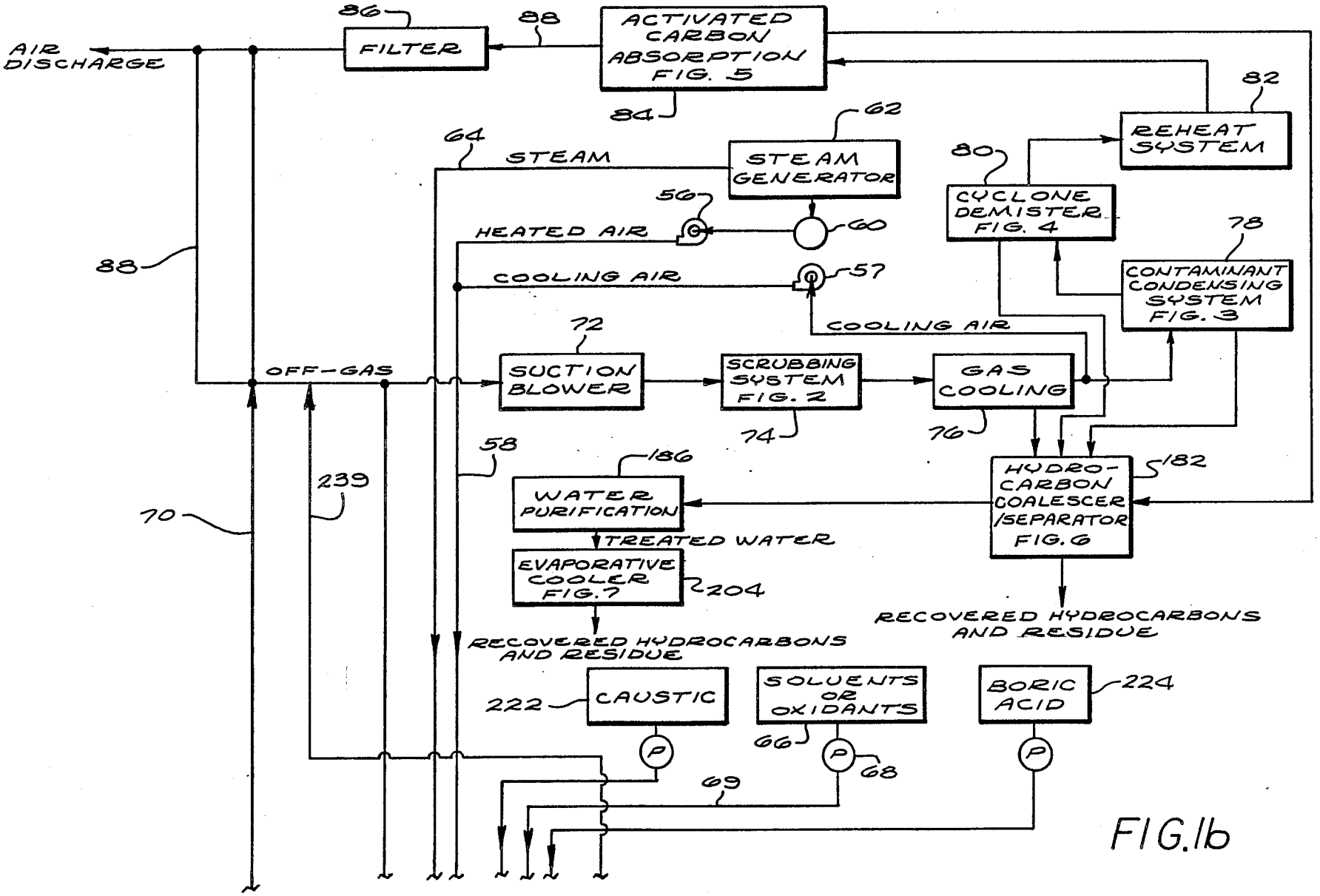
Figure 1C:
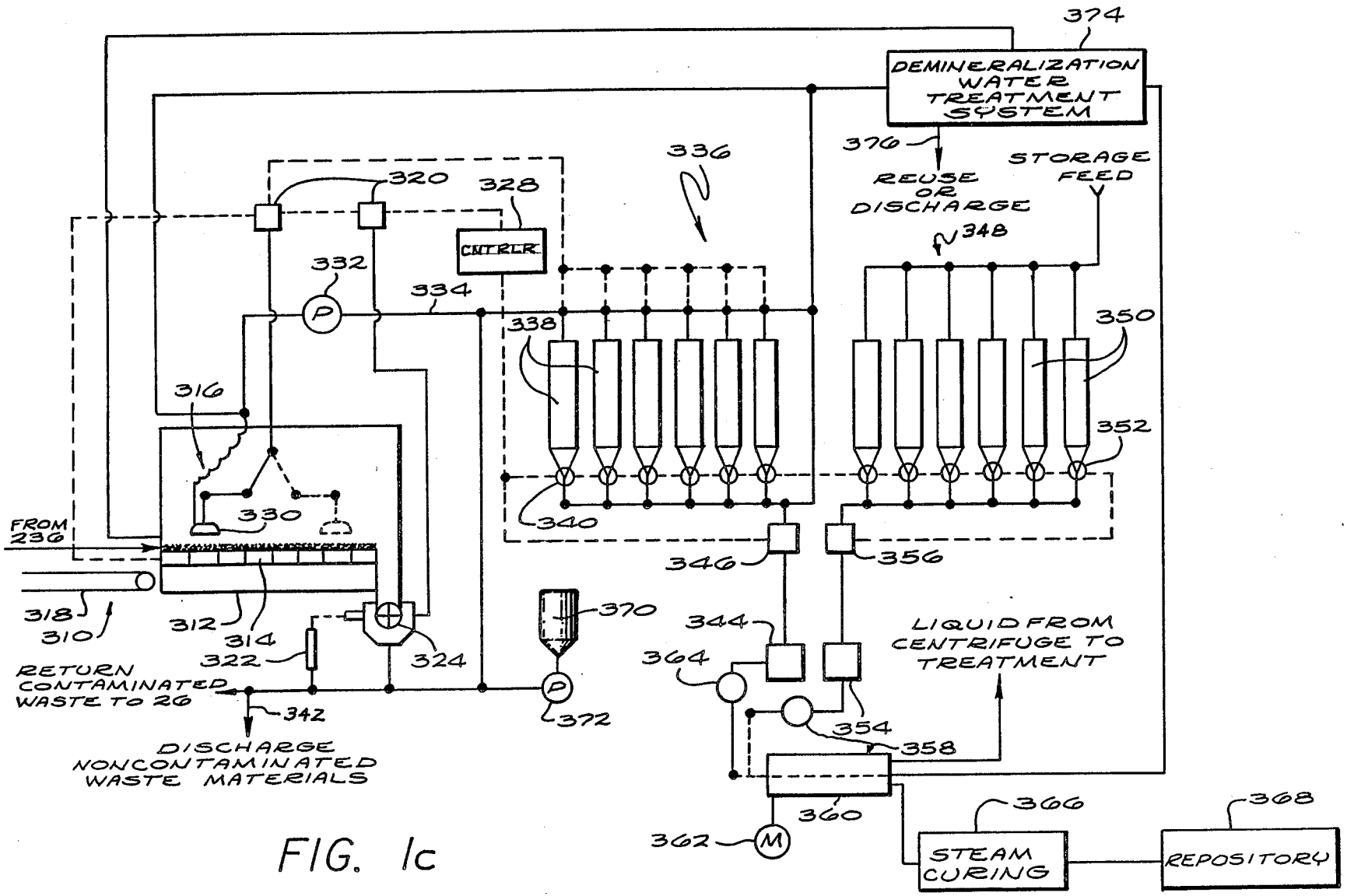

Referring more particularly to FIGS. 1*a*, 1*b* and 1*c* of the drawings, a reactor section 10 in accordance with the present invention removes any volatiles and hydrocarbons from waste w to be treated in an enclosed reactor vessel 12 in which is arranged a manifold 14 including a hollow stem 16 from which extends a plurality of hollow arms 18 forming nozzles for directing fluid jets into wastes w received in vessel 12. Manifold 14 is mounted for rotation within vessel 12 as by suitable bearings 20 and 22. A conventional electric motor 24, and the like, can be used to rotate stem 16 as desired.

Untreated waste w is fed into the system by a gross sorting table 25 which includes, for example, a suitable conveyor 27 having disposed above it a series of detectors 29. A push bar 31 is disposed between conveyor 27 and detectors 29 for selectively removing, as by manual actuation, any wastes w which do not require disposal as radioactive waste. In addition, unmixed wastes also can be sorted by table 25 and sent directly to sorting table 312 (FIG. 1*c*). It is to be understood that table 25 can be constructed in the manner of table 312 if so desired. Use of gross, or pre-sorting, table 25 eliminates the expense of unnecessary treatment, casting, and storage of non radwastes and non-mixed radwastes.

Waste w to be treated is fed by a line 26 from a gross sorting table 25 to a shredder 28 which pulverizes the waste in a known manner to a minimal particle size. Once shredded, the waste w is fed by a waste feed line 30 into vessel 12 through a suitable opening (not shown) provided in the vessel 12. The level of wastes w in the vessel 12 is monitored by probes 32, which also function as radioactive contaminant measuring probes by connection thereto of a solid radioactive waste contamination monitors 34 and a PH monitor 36. A conventional analyzer and recorder 40 is connected to both monitor 34 and 36 to compare measured levels with predetermined levels.

A radioactive waste interface sensor system such as manufactured by Fluid Components, Inc. (FCI) of San Marcos, California, is suitable for use as a level sensing system with vessel 12.

A line 42, used to sample gases given-off by reactor vessel 12, feeds a monitor 44 which measures contamination in the gases. An analyzer and recorder 46 is connected to monitor 44 for comparing measured levels with predetermined levels. Waste w in vessel 12 is measured for volatiles, hydrocarbons, organics, and the like, by a flame ionization detector (FID) 48 and a gas chromatograph (GC) 50 both connected to a suitable chart recorder 52 and the like.

Wastes w are subjected to heat as by heated air fed into manifold 14 during rotation thereof by motor 24 through a swivel 54 connected to a blower 56 by a line 58. Blower 56 draws air through a conventional heat exchanger 60 which heats the air prior to its being applied to waste w contained in vessel 12. Cool air can be mixed if desired from a blower 57.

If volatiles and the like are indicated by FID 48 and GC 50 as present in high concentration in the waste w in vessel 12, a steam generator 62 can be connected to swivel 54 as by a line 64 to more effectively strip the volatiles. In combination with the application of heat, oxidants or solvents are introduced directly into vessel 12 from a tank 66 having associated with it a feed pump 68 connected to vessel 12 by a line 69.

Steam at, for example, 50 psi and 300° F. can be injected into the treatment reactor at a rate of 2000 lbs/hr maximum. Compressed air at, for example, 100 standard cubic feet per minute (SCFM) and 50 psi can also be injected alone or simultaneously with the steam. Heat from generator 62 can be used to heat air in exchanger 60.

For safety considerations, the reactor vessel 12 is equipped with the surveillance detectors formed by FID 48 and GC 50 and an automatic airflow bypass switch (not shown). Warning lights (not shown) and the automatic bypass switch are activated by a signal from the computerized data monitoring system whenever the specified levels of radwaste and organic concentrations are detected. A warning light will be activated whenever the reactor off gas concentration reaches predetermined total hydrocarbon levels as measured by the FID 48. The predetermined level will represent a parameter established for the off gas cleanup. The alarm (not shown) will serve as a signal for operators (not shown) to become aware of any potential problem that may arise and to monitor operations closely for this contingency.

The off-gas treatment process is used to recover volatile contaminants removed from the waste w by the reactor stripping procedure using air and/or steam as described above. The system can be designed to handle air saturated with water and containing a maximum of, for example, 50,000 ppm of volatile organic components (VOCs).

During the process of stripping volatiles, gases being given-off are removed from vessel 12 through a line 70 having a suction blower 72 inserted in it.

The stripping reactor system 10 and its operation are tailored to match the characteristics of the gas expected from the waste. As shown in FIGS. 1*a* and 1*b*, the gases containing volatiles and hydrocarbons emitted by the stripping are collected and first pass through a scrubbing system 74 to remove entrained solids. The gases are than cooled in a gas cooling device 76, such as a conventional cross-flow finned tube heat exchanger (not shown) and sent to blower 57 and to a contaminant condensing system 78, which may be a two-stage refrigeration system, where the bulk of the volatile organics are condensed and removed from the gas stream. Liquid droplets entrained in the gas stream are removed in a cyclone demister 80 which follows the condensing system 78. The gas is reheated by a reheat system 82 and then sent to a regenerative carbon adsorption system 84 for removal of residual VOCs. An absolute or high efficiency particulate air (HEPA) filter 86 removes radwaste contaminated air prior to release thereof to the environment. The processed gases are finally destroyed or, if still contaminated, fed back to blower 72 by a return line 88. A more detailed description of the gas processing system is presented below.

The off gas suction blower 72 conveys shroud off gas to the scrubbing system 74. This helps remove volatilized contaminants from the waste w, and minimizes the escape of volatiles and dust to the atmosphere. A suitable suction blower 72 could have, for example, a design capacity of 1,500 atmospheric cubic feet per minute (ACFM) and a nominal operating rate of 1,300 ACFM. The design air discharge pressure would be about 50 inches of vertical water column. Such a blower 72 could be a centrifugal type unit equipped with a 25-horsepower motor.

The suction blower 72 discharges into the off gas scrubbing system 74 for removal of entrained particulates. As seen in FIG. 2, an hydraulically driven spinning atomizer 110, such as an "EMCOTEK" hydraulic RA-30 scrubber, atomizes the circulating scrubbing water in system 74. The circulation flow rate is adjustable from, for example, 0 to 20 gpm. Dust particles in the gas attach themselves to the fine water droplets and are subsequently removed in the cyclonic separator 112. The cyclonic separator 112 can be designed to remove water droplets of, for example, 6 microns or larger. A "Yorkmesh" demister pad 114 follows the cyclonic separator 112 to eliminate virtually all smaller size water droplets. The circulating water is collected from the bottom of the cyclone in a circulation tank 116 by a pipe 118. A small flow is continuously withdrawn from the tank 116 and is circulated through a particulate removal filter 120 to prevent build-up of these impurities.

The particulate removal filter 120 can be, for example, a cartridge type filter designed to handle water flow rates from, for example, 0 to 5 gpm. A fibrous filter cartridge is capable of removing particles down to about 20 microns in size. The filter 120 is equipped with differential pressure gauges 121 to indicate the condition of the filter element. When the pressure drop through the filter becomes excessive, indicating that the filter is badly plugged, the water flow will be shut off and the filter cartridge replaced.

After passing through the particulate removal filter 120, the scrubber water is usually recycled back through a normally open valve 122 to the gas scrubber circulation tank. If desired, however, the water can be sent through an activated carbon filter 124 by opening a normally-closed valve 126 for removal of absorbed/entrained contaminants on an as needed basis. Under normal operating conditions, there will not be an appreciable build-up of organic contaminants in the circulating water. But, if pockets of heavy contamination are encountered in the wastes w for prolonged periods of time, there may be a need to treat the water through the carbon filter 124 periodically for, for example, a few minutes at a time.

The filter 124 can contain about, for example, 200 pounds of activated carbon, and handle up to 5 gpm of water. Organic contaminants should be removed to less than about 1 ppm whenever the filter 124 is used. The activated carbon can be replaced whenever the filter effluent concentration rises above, for example, 10 ppm, indicating that the carbon has reached the specified breakthrough level. A pump 128 feeds circulating water from tank 116, with a valve 130 regulating flow to filter 120. A valve 132 controls flow from tank 116 to pump 130, and a further valve 134 controls flow from pump 128 to section 110 together with a flowmeter 136.

Gas flow from the scrubber at about 160° F. is cooled to 90° F. in the gas cooling device 76. The design duty of device 76 can be about 1.5 MM Btu/hr. During the cooling process, most of the steam along with some contaminants in the gas will condense.

Process gas is further cooled from about 90° F. to −10° F. in the condensing system 78 as shown in FIG. 3. The purpose of the system 78 is to reduce high organic concentrations in the gas to prevent overloading of the downstream carbon adsorption system 84. The system 78 preferably is a two-stage refrigeration system with cooling to, for example, about 35° F. in a first stage 138, and to about −10° F. in a second stage 140.

Most of the steam will condense out in a heat exchanger 139 of the first cooling stage 138 at about 35° F. A separation unit (not shown) can be provided after the first stage 138 to remove this condensate and to send it to a coalescer/separator. Most of the organics will normally condense out in the second cooling stage 140 at lower temperatures. The second stage 140 includes two banks of heat exchangers 142 and 144 that alternate between cooling and thawing cycles. A warm brine can facilitate thawing by passing through the tubes. All condensate from the second stage 140 is removed in the downstream demister 80 and sent to a coalescer/separator. A refrigeration unit 146 supplies a coolant to the heat exchangers 139, 142, and 144.

Figure 4:
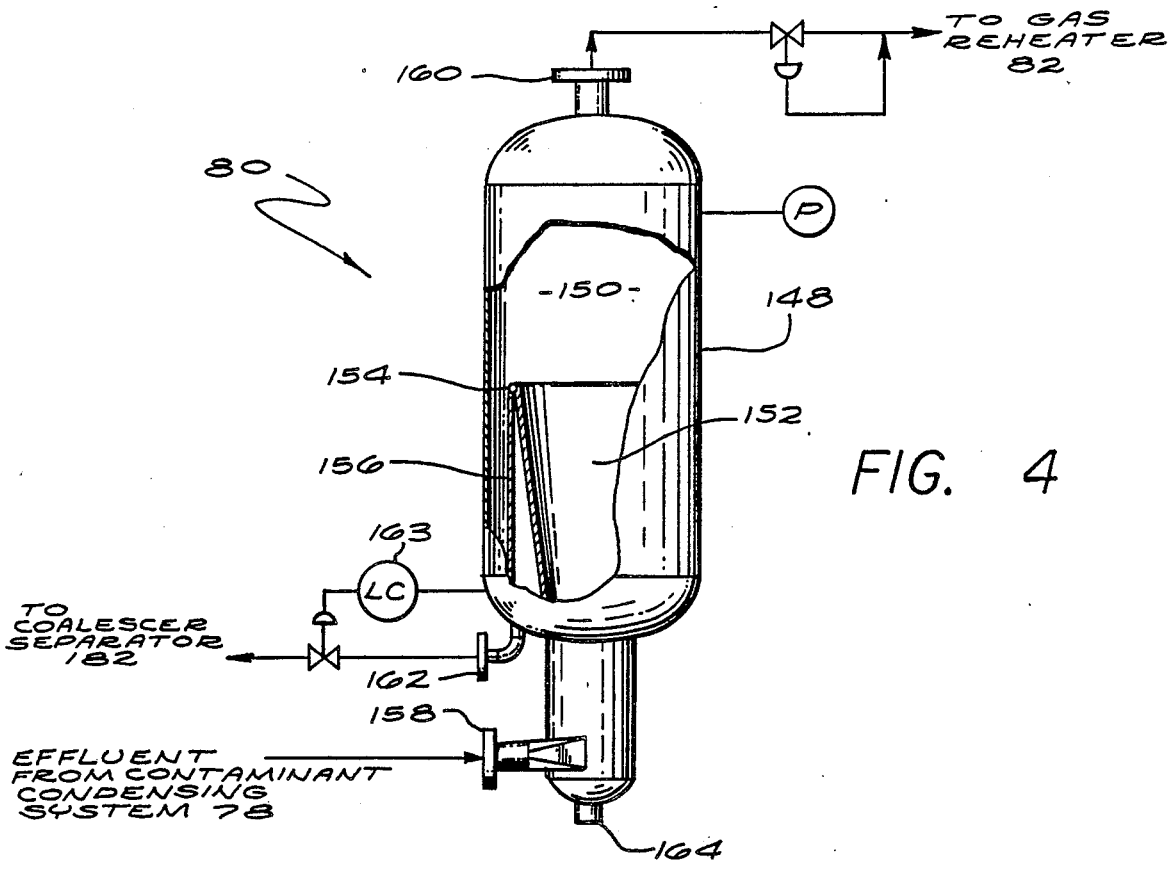
FIG. 4 is a diagrammatic, side-elevational view, partially cut away and in section, showing a cyclone demister usable with the waste processing system of FIGS. 1*a* and 1*b*.

The cyclone demister 80, a centrifugal device, shown in FIG. 4, separates liquid droplets that may be entrained in the gas stream exiting the condensing system 78. This is necessary to keep liquid from contacting the carbon in the downstream activated carbon system 84. The cyclone demister can be designed to remove liquid droplets down to, for example, 4 microns in size.

As can be seen from FIG. 4, demister 80 comprises a vessel 148 forming an enclosed chamber 150. In the bottom portion of chamber 150 is disposed a vortex section 152 defining a lip 154 joining with an outer shroud 156. Effluent from condensing system 78 is injected as a gas into chamber 150 through an inlet 158 leading upwardly through vortex section 152 and out an outlet 160 at the top of the vessel 148. Condensate on lip 154 is collected beneath shroud 156 at an outlet 162 and fed to a coalescer separator. A level control valve 163 regulates flow from outlet 162, while a normally-closed drain 164 permits periodic purging of vessel 148.

Cyclone demister 80 effluent, at about, for example, −10° F. is sent through the gas reheat system 82 to raise the gas temperature to about 55° F. before it enters the activated carbon adsorption system 84. This temperature is near the optimum for carbon adsorption of organics on activated carbon. Heating also lowers the relative humidity such that residual water vapor in the gas does not compete with the organics for adsorption onto the carbon.

The gas reheat system 82 can be a cross-flow finned tube heat exchanger similar to the gas cooler device 76, and can use cooling water at, for example, 85° F. as the heating medium.

Figure 5:
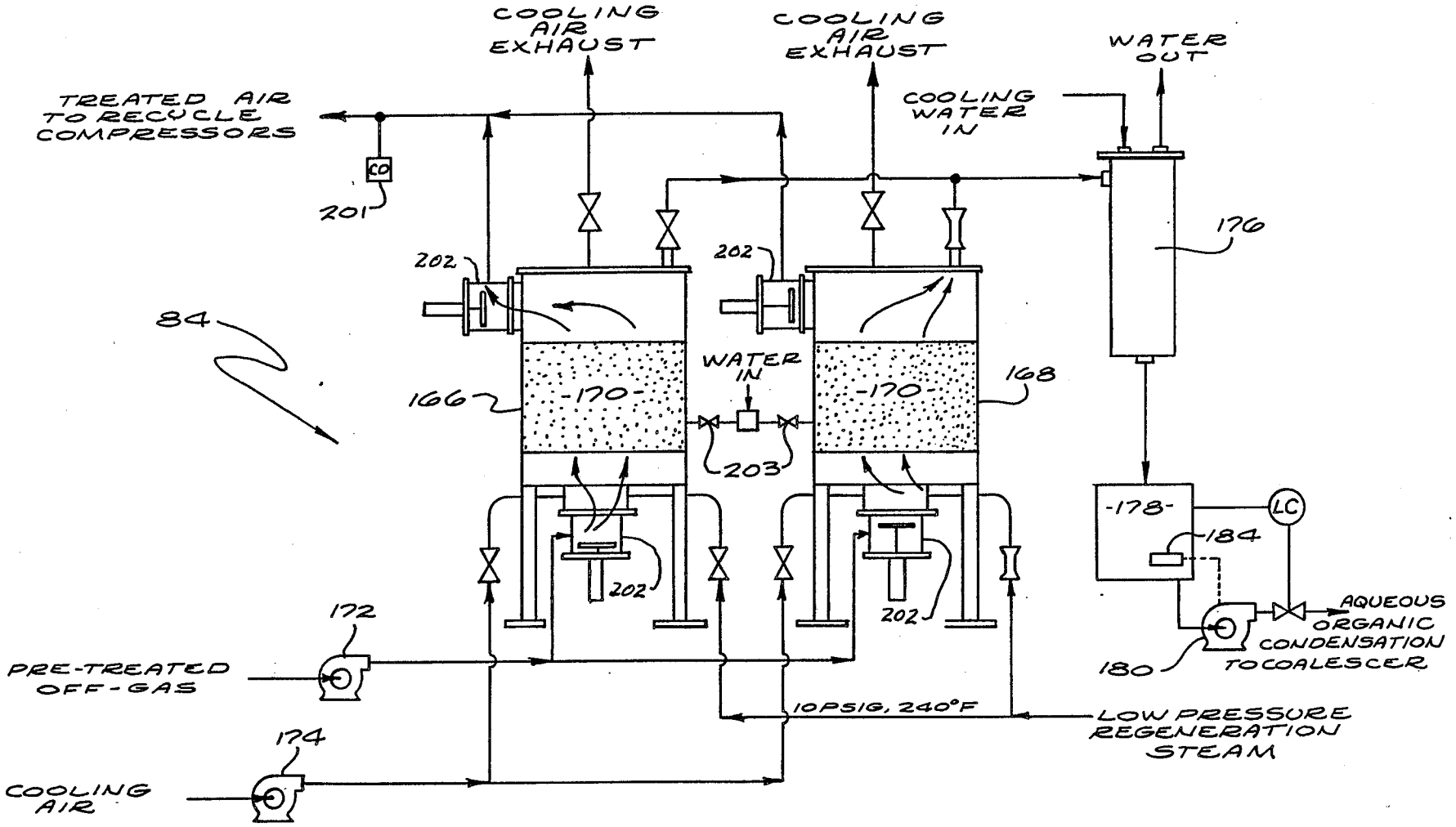
FIG. 5 is a diagram showing a regenerable activated carbon adsorption system usable with the waste processing system of FIGS. 1*a* and 1*b*.
Figure 6:
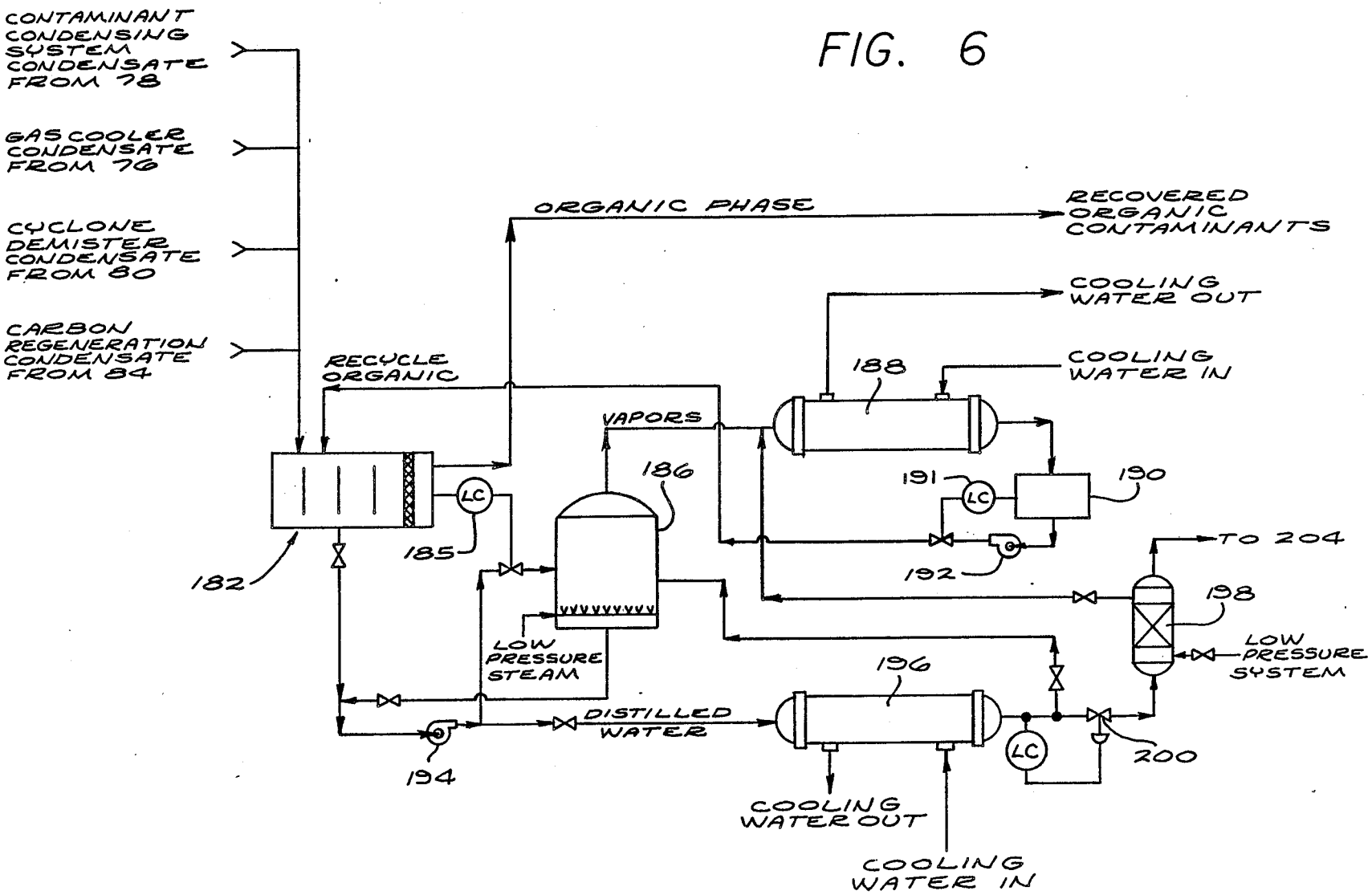
FIG. 6 is a diagram showing a condensate treatment system usable with the waste processing system of FIGS. 1*a* and 1*b*.

Pretreated gas at about 50° F. is sent through the regenerative activated carbon adsorption system 84 and filter 86 for removal of residual VOCs from the gas before it is discharged to the atmosphere. Contaminant removal efficiency will normally be approximately 95 percent. The activated carbon will be automatically regenerated every third hour of operation. During the adsorption cycle, both the carbon bed feed and the effluent gas organic concentrations can be monitored and periodically recorded using an on-line total hydrocarbon analyzer (not shown) and the like. The periodic sampling and monitoring procedure will provide a good check on carbon adsorption efficiency. The main components of a preferred carbon adsorption system 84 as shown in FIGS. 5 and 6 include two activated carbon adsorption vessels 166 and 168 each provided with a carbon bed 170. A process blower 172 and an air blower 174 are provided to blow gas and dry air alternatively through vessels 166 and 168. The system is essentially a dual tank, fixed carbon adsorption module designed for safe, energy efficient industrial use, and operates on the principle that organic compounds in gas forced through a bed of activated carbon as by a blower 172 will absorb or collect in the carbon pores. Organic molecules adsorbed on the porous carbon surface will remain there until vaporized by steam heat during regeneration. As steam at 10 psig and 240° F. is injected into the carbon bed 170, the organics will desorb from the carbon and will be condensed along with the steam in a condenser 176, which can be a water-cooled heat exchanger. The condensate is collected in a small transfer tank 178. The dry cooling air blower 174 is activated after steaming to reduce the bed 170 temperature. Some moisture will remain on the carbon bed 170 to provide the appropriate relative humidity desired for the next adsorption cycle.

The condensed aqueous/organic mixture is pumped as by a pump 180 from the transfer tank 178 into a four-stage coalescer/separator 182. Condensate from the contaminant condensing system 78, the gas cooling system 76, and the demister 80 also are fed to the coalescer/separator 182. The transfer pump is activated by a level control float 184 in the transfer tank 178. The coalescer/separator 182 contains an internal coalescing element that enhances hydrocarbon/water separation. After physical separation of the two phases is complete, the organic contaminant overflows a weir (not shown) into, for example, a 1500-gallon hydrocarbon holding tank for subsequent transfer and treatment. The recovered water phase containing about 30,000 parts per million (ppm) organics is pumped from one of the coalescer compartments into a distillation unit 186 for additional treatment. A level-control float 185 in the coalescer water compartment activates a water transfer pump 194. The steam heated distillation unit 186 heats and boils the water at 212° F. to drive off most of the residual organics. The overhead distillation vapors are condensed in a water-cooled condenser 188 and collected in a small organic transfer tank 190 for subsequent recycle back to the coalescer/separator 182. The organic transfer pump 192 is activated by a level-control float 191 in the transfer tank 190. Distilled water containing less than 400 ppm residual organics is then pumped by transfer pump 194 through a heat exchanger 196 for cooling and then through a small activated carbon filter 198 for removal of trace contaminants to less than 1 ppm. A temperature controlled valve 200 regulates flow from exchanger 196 to filter 198. The treated water is sent to the cooling tower as part of the make-up water requirement.

The small liquid phase activated carbon filter 198 contains about 250 pounds of carbon and can be regenerated, for example, every 6 hours with steam on a time cycle. Any regeneration of gases containing steam and volatized organics will be sent to the condenser 188.

During operation, only one of the two vapor phase carbon absorber beds 170 will be on the adsorption cycle at any given time. The other carbon bed 170 will be on standby or in the process of being regenerated. The adsorption and desorption cycles can be automatically controlled into a conventional manner by system sequencing timers (not shown), but manually overridden in a conventional manner not shown.

Each of the large absorber beds 170 may contain about 990 pounds of activated carbon, and capable of absorbing about 99 to 130 pounds of organics before regeneration is required. A regeneration cycle, including steaming and air cooling, can be completed in, for example, a 1¼ hour period. Low pressure steam (10 psig, 240° F.) can be used for regeneration at the rate of 120 pounds steam per cycle. Steam from the same regeneration boiler can be made available for the distillation unit 186 at 530 pounds per hour and for regenerating the small liquid phase activated carbon filter at 60 pounds per hour after regeneration of the large absorber beds 170 is complete.

During adsorption, a carbon monoxide (CO) analyzer 201 will continually monitor the absorber exit stream for carbon monoxide. If the analyzer senses more than, for example, 400 ppm carbon monoxide, indicating a possible fire in a carbon bed 170, an alarm contact (not shown) will close. Feed gas and exhaust valves 202 will be closed and a water deluge valve 203 on the specific absorber vessel 166, 168 opened automatically in a known manner allowing water to enter and drench the carbon bed 170. The water deluge valve 203 is manually closed after a short period of time and the water drained. Drainage water can be treated in the coalescer/separator 182, distillation unit 186, and carbon filter 198, and sent to a cooling tower 204 (FIGS. 1*b* and 7) as make-up water.

Figure 7:
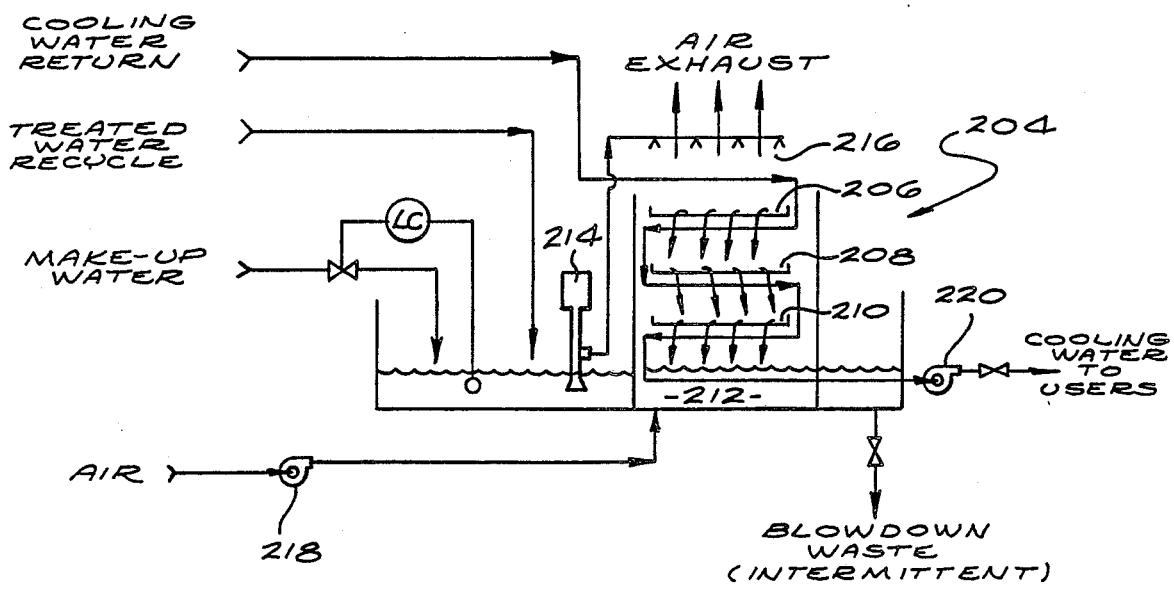
FIG. 7 is a diagram showing an evaporative cooler usable with the waste processing system of FIGS. 1*a* and 1*b*.

An evaporative cooling tower 204 shown in FIG. 7 provides cooling water at, for example, 85° F. to all of the cooling equipment in the process described above. Makeup water to the cooling tower 204 is provided by recycling treated condensation from the process and plant water. A design duty for the above example would be about 2 MM Btu/hr. The cooling tower 204 is periodically drained on a batch basis to prevent excessive buildup of particulates and total dissolves solids.

The cooling tower 204 as illustrated in an evaporative cooler with a plurality of cascade levels; three levels 206, 208, and 210 being shown, but it being understood as many levels as necessary can be employed. A sump 212 is disposed at the bottom of tower 204. A cooling tower pump 214 elevates water from sump 212 to nozzles 216 at the top of tower 204, while a cooling tower blower 218 forces air upwardly from the bottom of tower 204. Chilled water is fed from sump 212 to the various stages of the process where needed by a pump 220.

Referring again to FIGS. 1*a*, 1*b* and 1*c* of the drawings, reservoirs 222 and 224 can be provided for a caustic and boric acid, respectively, which can be added to the reactor vessel 12 after removal of volatiles to adjust the pH of waste w, and to reduce some of the concentration levels of the waste w. Solvents and oxidants from tank 66 may also be added to waste w at the time to cause a reaction which releases some of the contaminants from waste w. Solvent liqueurs are released from vessel 12 by a line 226 and fed to a solvent recovery system 228. Solvents are discharged at line 230, while contaminated residues are returned to treatment at line 232.

When monitoring of gases being given off indicates an absence of gases, the treated wastes w are discharged from a port 234 of vessel 12 to a suitable dryer 236. Vapors generated in dryer 236 are vented and fed by a line 239 to suction blower 72 for processing in the gas treatment section described above.

Dried waste w is discharged from dryer 236 and is passed to a suitable sorting and separating conveyer table 312, preferably constructed from a shielding material such as lead, disposed in an enclosed area. An upper surface of table 312 is covered with a series of radiation detectors 314 arranged in ascending or descendingg levels, for example. Conveyor and sorting tables with radiation monitoring is available from National Nuclear Corporation of Mountain View, Calif. Adjacent table 312 is one or more suitable, manipulators 316, such as a surveillance robot. Among manufacturers of suitable manipulators are Action Machinery Company of Portland, Oregon, telerobotics, Inc., of Bohemia, New York, N.Y. GNL Associates, Inc., of Oak Ridge, Tenn., is a source of radiation detector systems.

Table 312 can be constructed in the manner of table 25 alternatively if so desired.

As waste w is passed along table 312, table detectors 314 monitor radiation in waste w, with manipulator 318 being capable of penetrating and removing waste w from above. The detectors 314 feed measurements resulting from this monitoring to recorders and analyzers 320. Connected to recorders and analyzers 320 so as to receive signals from it is a menu programmer controller 328, which may be a conventional microprocessor, arranged for directing waste w to storage based on the data received from the monitors.

Specific contaminant discrimination requires analysis of small areas. But, detector physics is such that very small detectors are inefficient. It has been determined that 4″×4″ detectors (100 $cm^2$) is about a minimum area that a detector can cover, with 8″×8″ (420 $cm^2$) having been found satisfactory. Square detectors have been found more efficient than rectangular detectors. Accordingly, a plurality of square zones (not shown) are formed on table 312 by detectors 314, which can be solid scintillated gamma detectors. Twelve to sixteen zones are considered optimum.

Digital masking or filtering techniques can be used to reduce effects of cross-talk between zones. These techniques effectively remove noise, cross-talk, and summation effects in a manner which highlight a given, central, one of the zones by comparing electronically a given zone with a mask including adjacent zones sampled simultaneously. Threshold levels of detectors 314 can be set for area (zone) contamination detection by comparing an entire mask of a detector 314 to a predetermined area activity in terms of disintegrations, time and area.

The waste w is spread over table 312, which preferably is fed by a slow moving belt or wire mesh conveyor 318, in a layer a few inches thick, for example. Detectors 314 can be cycled continuously in time coordination with movement of conveyor 318. Pusher bars (not shown) and the like can be provided for assisting material flow over table 312. Controller 328 receives signals from detectors 314 and recorders and analyzers 320 signals identifying the nature of contaminants in each zone represented by a detector 314. The information so received by controller 328 permits controller 328 to instruct manipulators 316 to locate a specific waste by zone, verify the identification by detector 316 mounted thereon, and remove a specific waste to a hood 330 for removal to storage.

During passage of waste w along the table 312, manipulator 316, in cooperation with detectors 314, operate to remove contaminated material, identified by detecting predetermined specific contaminants in that portion of the wastes from which any volatile hydrocarbons have been removed, by a hood 330 having a suction drawn through it by a vacuum pump 332 inserted in a line 334 leading to a storage area 336 formed by a plurality of storage bins 338 each provided at the bottom with an associated rotary feed lock 340. The waste w is discharged through a rotary lock feeder 324, and the like, controlled by controller 328. A detector 322 makes a final check of waste w and should waste w be found not contaminated it is discharged at 342. If, however, detector 322 finds waste w to be contaminated, the waste w is returned to the waste inlet at line 26 for reprocessing.

When controller 328, which also can be a manual operator (not shown), is advised that waste in a bin 338 has reached a predetermined level, an associated rotary feed lock 340 is opened to feed waste to a mixer 344 together with a predetermined amount of water from a water feed system 346.

A storage area 348 for shielding materials which can include ceramic, enamel, concrete, or metal comprises a plurality of tanks or bins 350 each provided with a rotary feed lock 352 at the bottom. When waste is fed to mixer 344, an appropriate shielding material, selected by such factors as waste being encapsulated and method of disposal, is fed from a bin 350 by opening an associated lock 352 and fed to a mixer 354 together with an appropriate amount of water from a liquid feed system 356. For a solid waste, the mixed shielding material is fed into a centrifuge 360 rotated by a motor 362 through a valve 358. Once a barrier is formed, mixed waste is fed into the centrifuge 360 by a valve 364. When the barrier is filled, the ends are sealed and the encapsulated waste removed to a room 366, and the like, where it can be cured, as by steam, and wrapped in polyethylene or other material. The cured casting is then disposed of as in a vault 368.

A demineralization closed-end wastes system 370, provided with a pump 372, flushes the system periodically to prevent potential recontamination of system feed lines. The flushing water is fed to a demineralization water treatment system 374 where it can be discharged through a port 376 for reuse or discarding as appropriate.

Referring to FIGS. 8 and 9, a batch or semi-batch centrifuge 360 according to the present invention comprises a mold or liner 410, formed from a ceramic, concrete, metal and the like, as a pair of semi-cylindrical shell halves defining spaced end portions 410*a* and 410*b* and a selectively secured in place by a plurality of line locks 412. A product feed pipe 414 is connected to liner 410 as by a swivel 416; the liner 410 being along a longitudinal axis mounted on rollers 418 for rotation by motor 362 through a drive train 420. A hollow, perforated, inner feed mandrel 422 is disposed along the longitudinal axis a—a of the liner 410 for injecting shielding material and wastes received from pipe 414 and swivel 416 into liner 410 as it rotates. Centrifugal force causes the materials fed into liner 410 to conform to an inner surface 411 of liner 410, with heavy phases of the materials "sinking" outwardly and less dense phases "rising" inwardly. Thickness of the barrier is determined by the mount of material fed. Liner 410 can be vibrated if desired. Pipe 414 is connected to the valves 358, 364 (FIG. 1*c*). A pair of moveable end pieces 424 and 426 are arranged on mandrel 422 for movement between a position inside the end portions 410*a*, 410*b* of the liner 410 as shown by broken lines, and a position outside of the liner 410 as shown by full lines. The dish-shaped end piece 424 is moved by a fluid motor (piston and cylinder) 428, connected to a piece 424 and mounted on a column 430 hinged at 432 to permit motor 428 to be pivoted out of the way to remove a casting from liner 410. A sleeve 434 permits piece movement of mandrel 422 to move dish-shaped piece 426 out of liner 410. When the end portions of the barrier are cast, the casting can be removed from centrifuge 360 by withdrawing mandrel 422 and pivoting motor 428 to a horizontal position (not shown).

FIGS. 10 and 11 show a finished casting 436 disposed within a liner 410. The barrier 437 encapsulates waste w, while an heat adsorption core 438, such as a suitable metal, is inserted into the space left by withdrawal of mandrel 422.

Waste w can be solid waste, or a mixture of waste and shielding material or suitable absorption reagents. Any excess liquid is drained continuously or intermittently from liner 410 for treatment or disposal as appropriate.

Figure 12:
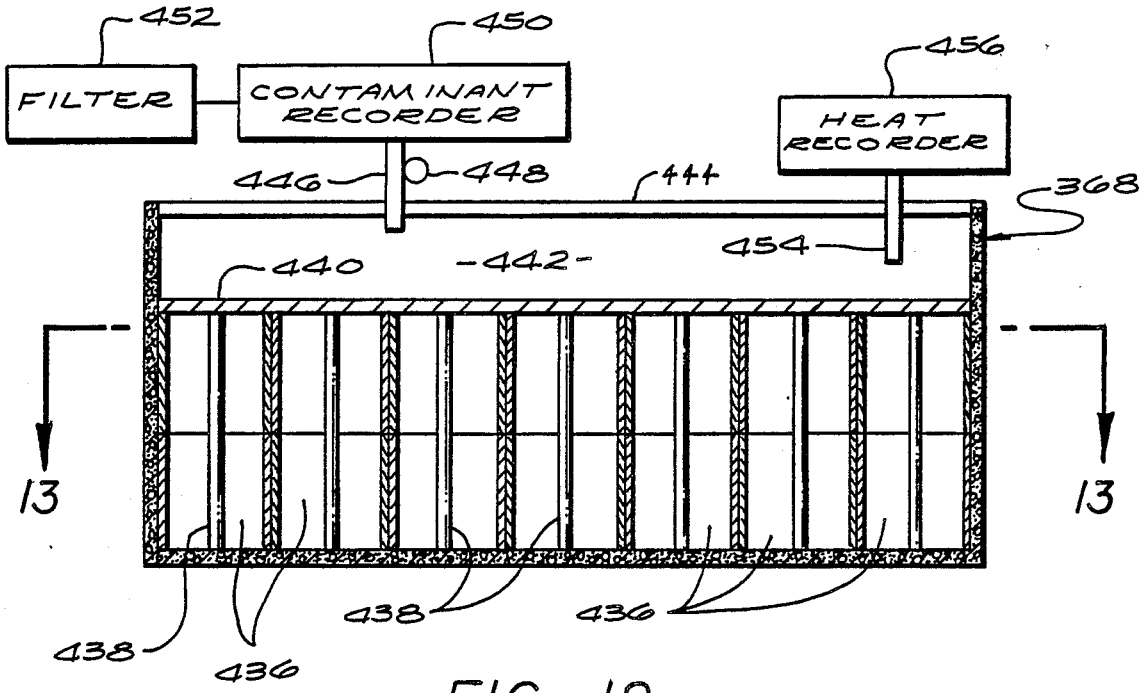
FIG. 12 is a diagrammatic, vertical sectional view showing a manner of disposing of castings according to the present invention in a burial vault.
Figure 13:
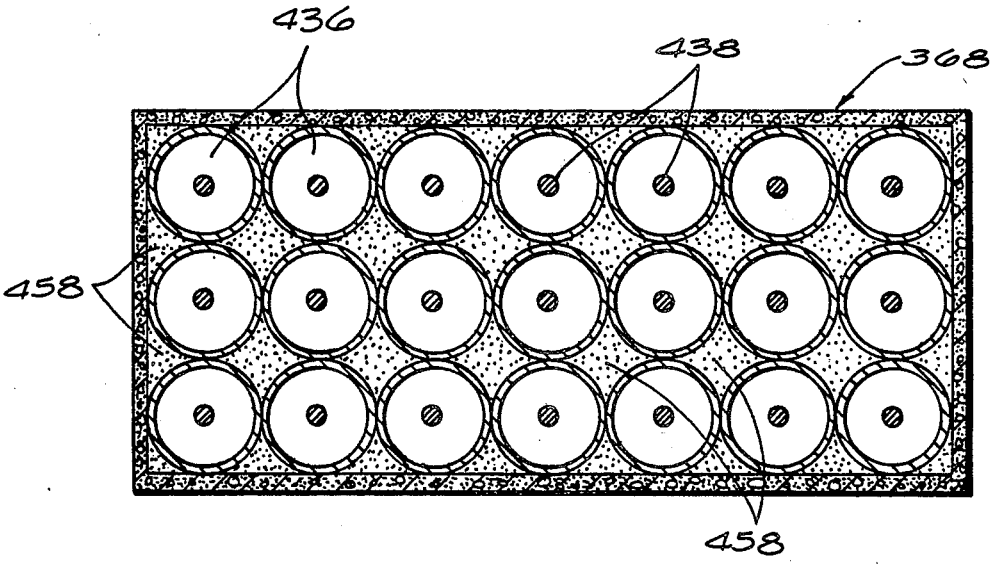
FIG. 13 is a diagrammatic, horizontal sectional view taken generally along the line 13—13 of FIG. 12.

FIGS. 12 and 13 illustrates a suitable vault 368 for disposal of castings 436. A heat absorption blanket 440 of a suitable known material is disposed over stacks of castings 436, with a chamber 442 being formed between blanket 440 and a cap 444 on vault 368. A vent 446 extends from the chamber 442 through cap 444 to permit a blower 448 to withdraw air from the vault 368. A recorder 450 measures the air for contaminants, while a filter 422 is disposed for filtering the air. A thermocouple 454 sends temperature signals to a recorder 456. All of the voids between the cylindrical, stacked castings 436 are filled with a shielding and heat absorption material 458.

Heavyweight concretes produced by using natural heavyweight aggregates are preferred as shielding. Concrete having a density greater than 200 pounds per cubic foot has been found satisfactory as a biological shielding material for barrier 437, with unit weights in a range of 210 to 240 pounds per cubic foot being optimum.

Persons skilled in the art will readily appreciate that various modifications can be made from the preferred embodiment thus the scope of protection is intended to be defined only by the limitations of the appended claims.

I claim:

1. A process of classifying, segregating, and isolating radioactive wastes initially present in a mixture into component fractions, comprising the steps of:

(a) heat stripping volatile fractions from said mixture;

(b) measuring the radioactivity of that remaining portion of the mixture from which said volatile fractions have been stripped;

(c) separating said remaining mixture into separate fractions each having a different range of radioactivity levels and storing said separated fractions (d) selecting at least one of a plurality of stored radiation shielding materials; and (e) casting said selected radiation shielding material and casting a selected one of said radioactive fractions with said shielding materials into a rigid shape such that said radiation shielding material encapsulates said radioactive fraction to substantially prevent the escape of radiation therefrom.

2. A process as set forth in claim 1, comprising the further steps of monitoring gases given off by the wastes during stripping, discharging said remaining portion of the wastes in the absence of gases given off, and drying said remaining portion.

3. A process as set forth in claim 1, wherein the step of casting said shielding material and said one of said radioactive fractions comprises centrifugal casting.

4. Apparatus for performing the process of claim 1, comprising, in combination:

(a) reactor means for subjecting wastes to be treated to heat to volatize volatile contaminants therein;

(b) conveyor means for receiving non-volatilized wastes from the reactor means and passing the wastes along a predetermined path;

(c) detector means disposed along said predetermined path for measuring the radioactivity of said in wastes passing along said predetermined path;

(d) separator means for separating the radioactive wastes into separate fractions each having a different range of radioactivity levels;

(e) storage means including a plurality of separate storage areas, each of which storage areas receives and stores a separate one of said separated radioactive fractions;

(f) means for separately storing a plurality of radiation shielding materials;

(g) means for casting a radiation shielding material and one of said separated radioactive fractions into a rigid casting; and (h) means for transferring said radiation shielding material and said fractions to said means for casting.

5. Apparatus as defined in claim 4, wherein said means for casting includes centrifuge means for receiving said shielding material and said radioactive fraction, a centrifuge liner mounted on the centrifuge means and said centrifuge including a mold and means for feeding a shielding material into said mold to form a centrifugal casting of a predetermined thickness of shielding material in the mold.

6. Apparatus as defined in claim 5, wherein the centrifuge means includes port means for drawing off excess liquid resulting from centrifugal casting.

7. Apparatus as defined in claim 4, wherein said separator means includes a hood and a vacuum pump connected to the hood for drawing off said separate fractions.

8. Apparatus as defined in claim 7, wherein said separator means includes a manipulator means for supporting and positioning the hood, and said detector means including recorder means for recording the detected radioactivity of said fractions.

9. A process as set forth in claim 1, wherein the step of heat stripping includes the step of applying a heated gaseous medium to wastes to be treated.

* * * * *